US005114534A

United States Patent [19]

Rachor et al.

[11] Patent Number: 5,114,534

[45] Date of Patent: May 19, 1992

[54] DRYING CELLULOSIC PULP

[75] Inventors: Donald G. Rachor, Puyallup; Richard F. Buchholz, Shelton, both of Wash.

[73] Assignee: Georgia-Pacific Corporation, Atlanta, Ga.

[21] Appl. No.: 625,112

[22] Filed: Dec. 10, 1990

Related U.S. Application Data

[63] Continuation-in-part of Ser. No. 524,039, May 16, 1990, abandoned.

[51] Int. Cl.[5] ..... D21C 9/00

[52] U.S. Cl. ..... 162/9; 162/13; 162/90; 162/100; 162/181.3

[58] Field of Search ..... 162/10, 181.3, 182, 162/100, 9, 13, 90

[56] References Cited

U.S. PATENT DOCUMENTS

| | | | |
|---|---|---|---|
| 1,809,286 | 6/1931 | Richter | 162/100 |
| 1,857,948 | 5/1932 | Dosne | 162/181.3 |
| 3,414,469 | 12/1968 | Brown et al. | 162/100 |
| 4,183,146 | 1/1980 | Tsukamoto et al. | 162/24 |
| 4,411,737 | 10/1983 | Galeano | 162/83 |
| 4,560,437 | 12/1985 | Kleppe et al. | 162/65 |

FOREIGN PATENT DOCUMENTS

| | | | |
|---|---|---|---|
| 1193808 | 9/1985 | Canada | 162/181.3 |

*Primary Examiner*—Peter Chin

*Attorney, Agent, or Firm*—Banner, Birch, McKie & Beckett

[57] ABSTRACT

A process for reducing the energy requirements for drying a cellulosic pulp slurry by contacting a pulp slurry with sodium sulfate before web formation, dewatering and drying.

15 Claims, 2 Drawing Sheets

DRYING CELLULOSIC PULP

CROSS REFERENCE TO RELATED APPLICATIONS

The present application is a continuation-in-part of applicants' now-abandoned application Ser. No. 524,039 entitled Drying Cellulosic Pulp, filed on May 16, 1990.

BACKGROUND OF THE INVENTION

1. Field of the Invention

This invention relates to a process for preparing a cellulosic market pulp, and particularly relates to a process for reducing the energy requirements associated with drying a cellulosic pulp slurry.

2. Description of Related Art

A variety of processes, both mechanical and chemical, are known for treating cellulosic materials, such as softwoods and hardwoods, to remove their lignin fraction and produce a cellulosic pulp suitable for making paper and related paper products. Included among the chemical processes are the well-known Kraft and sulfite pulping processes. In the Kraft pulping process, a cellulosic source such as wood chips is digested with an alkaline pulping liquor containing sodium hydroxide and sodium sulfide; while the sulfite process, as the name implies, employs a sulfurous acid solution of an alkali or alkaline earth metal sulfite to effect lignin removal. All known processes also generally rely on some type of post-digestion bleaching to obtain additional lignin removal, and increase the whiteness and brightness of the pulp. To produce a marketable pulp product having a sufficient whiteness and brightness, the lignin content of the pulp generally should be reduced to below about 10 weight percent.

After bleaching, the cellulosic pulp at a consistency anywhere between about 8 and 15 weight percent, is washed to remove residual digestion and bleaching chemicals. The bleached aqueous pulp slurry having up to about 15 weight percent pulp solids may be held in inventory pending further processing. The pulp slurry at this point is suitable for making paper.

Often, however, instead of making paper with the pulp, the slurry is dewatered and dried to a moisture content of less than about 15 weight percent, preferably between about 3 and 10 weight percent. Continuous sheet forming and drying can be accomplished, for example, generally using one of three different types of equipment: the cylinder, Fourdrinier (i.e., single wire), and twin-wire machines, to produce a solid pulp product which can be compressed and baled convenient for storage and shipment. When this market pulp is rehydrated and redispersed in water, the resulting pulp slurry can be used for making paper products.

Dewatering and drying an aqueous pulp slurry is, as one might expect, a very energy intensive process. The dilute aqueous slurry of cellulosic, e.g. wood, fiber is directed onto a traveling screen for an initial, gross separation of water from fiber. As the water flows through the screen openings, fiber is accumulated and retained on the screen surface to form a wet, fibrous mat. Additional water is subsequently removed from the mat by mechanical pressing.

Screening and pressing steps remove approximately 96% of the water initially present in the original slurry leaving a consolidated pulp mat containing approximately 70 to 55% water and correspondingly 30–45% oven dry fiber. Since a satisfactory market pulp should contain approximately only 5 to 15% water in relation to the dry fiber weight, such additional water removal is normally accomplished by means of thermal vaporization. For this purpose, the pulp mat generally is passed in intimate surface contact over a series of steam heated, rotating cylinders, such mat being pressed against the hot surface of each cylinder about a major portion of its circumferential arc.

In summary, the three steps which are typically used to form a final market pulp product from a cellulosic pulp slurry, such as a bleached wood pulp, all relate to the removal of water from the fiber mat or web. These include:

(1) depositing pulp upon a screen (or "wire") to form a mat or web of pulp fiber. This step, known in its initial stage as formation, is usually accomplished by passing an aqueous dispersion of a low concentration of pulp (e.g., 0.2% to 1% by weight solids) over the screen. This screen, assisted in certain situations by vacuum or suction, increases the consistency of the mat or web to approximately 18 to 23 weight percent solids. Often during formation, a spray or shower of water also in directed onto the mat or web carried by the screen.

(2) compressing or squeezing the mat or web in a "press section" to remove additional water. This is usually accomplished by felt presses, a series of rollers each having a felted band for contact with the mat or web. These presses remove additional free water and some capillary water, thus resulting in an increase in consistency of the mat or web to a range of about 30 to 45 weight percent.

(3) drying the mat or web utilizing steam-heated equipment in a "dryer section." Here, the remaining water content of the mat or web is reduced to that desired for the final specific product, the consistency of which typically ranges between about 90 to 97 weight percent, more usually between 92 to 96 weight percent.

As mentioned above, the greatest energy use occurs during the thermal (steam-assisted) drying of the pulp product. Drying is a relatively expensive process, and the cost of drying is always a major part of the processing cost of the final pulp product. Anything that can be done to reduce the energy required to produce a dry, solid pulp product will have a significant impact on the overall economics of the pulping operation. The present invention relates to a process for reducing the energy requirements of the pulp drying process during the initial manufacturing of the pulp product.

DETAILED DESCRIPTION

Figure 1:
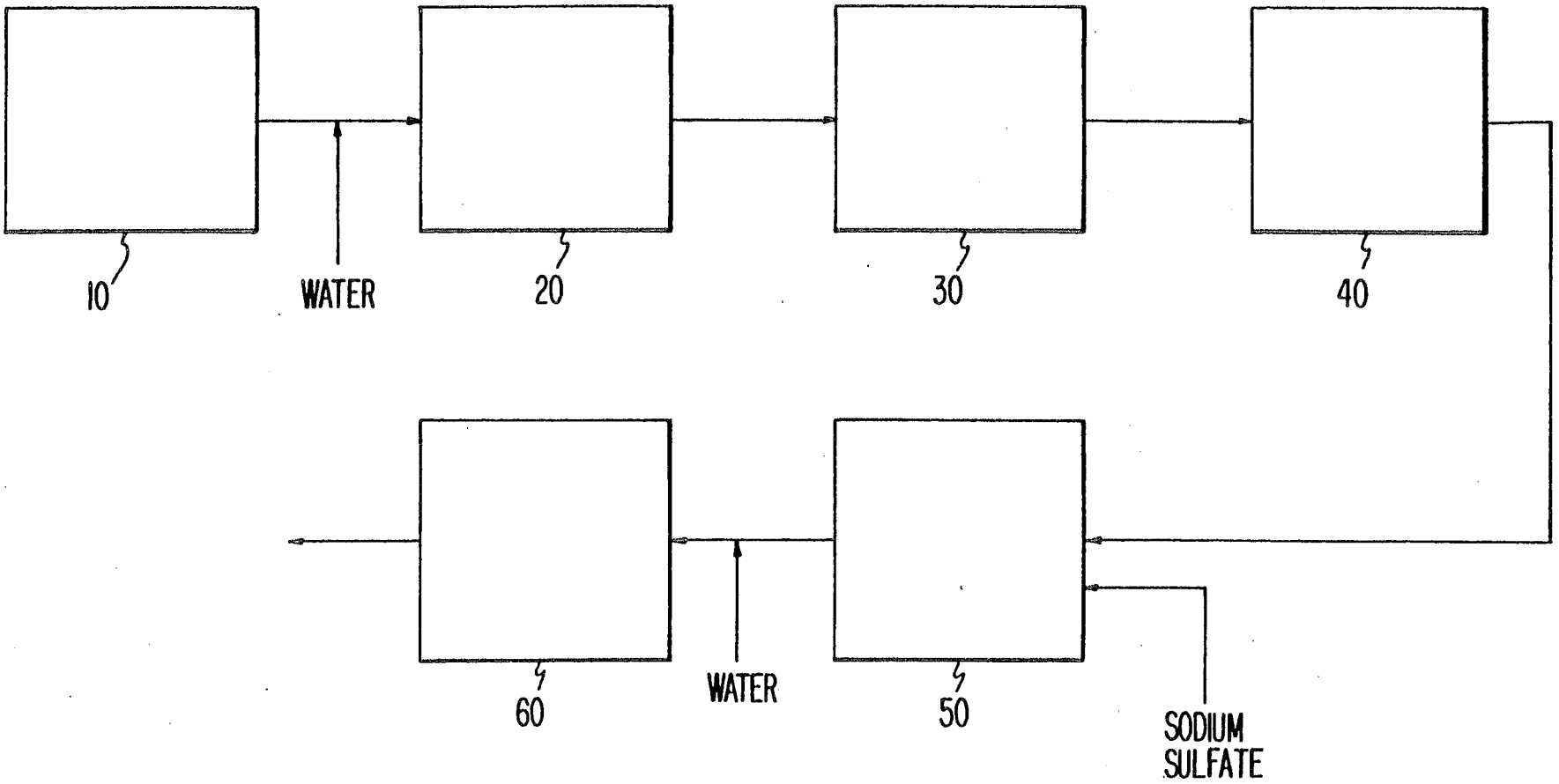
FIG. 1 schematically illustrates a process for treating a bleached sulfite pulp slurry in accordance with the present invention.

The present invention is directed to an improvement in the dewatering and, in particular, the drying of aqueous cellulosic pulp slurries. The invention comprises a method for reducing the energy needed to form a dried pulp mat from a cellulosic pulp slurry which comprises contacting said cellulosic pulp slurry with sodium sulfate in an amount between about 0.005 and 0.5 parts by weight of sodium sulfate per 100 parts by weight of oven dry pulp solids in said slurry, dewatering said treated slurry to form a mat of said pulp solids and drying said mat to produce said dried pulp mat, wherein said contacting between said cellulosic pulp slurry and said sodium sulfate is continued for a time sufficient to reduce the energy needed to form said dried pulp mat. The pulp slurry can be dried using any suitable procedure, such as by contacting a dewatered mat of the slurry with a series of steam-heated rolls.

Canadian Patent 1,193,808 describes a process for producing a pulp product having improved strength, drainability and beatability. According to the disclosed process, a low-molecular weight salt must be present during at least the initial phase of pulp drying so that it can penetrate into the fiber structure and prevent fiber collapse during drying. In Example 11 of this patent, the low-molecular weight salt is applied onto the wet web ahead of the press section. While sodium sulfate is included in the class of suitable low-molecular weight salts, the patent does not indicate that the added low-molecular weight salt has any impact on the energy needed to dry the pulp slurry. The process of the Canadian patent differs from the present invention in that the low-molecular salt must be present during pulp drying, whereas in the present invention the sodium sulfate is added to the pulp slurry prior to web formation. Upon forming the web by dewatering, usually with a shower assist, the sodium sulfate unavoidably is washed out from the pulp and is not present during pulp drying.

Essentially any cellulosic pulp, bleached or unbleached, can benefit from the process of the present invention. Suitable pulps include those produced using chemical digestion techniques, such as Kraft pulp and sulfite pulps, those produced using mechanical procedures, such as refiner mechanical pulps, as well as those produced using a combination of mechanical and chemical treatments. Both bleached pulp and non-bleached pulps can be treated with advantage.

In accordance with the present invention, sodium sulfate is added to the aqueous pulp slurry prior to web formation in an amount between about 0.005 and 0.5 percent by weight of oven dried solids in the pulp slurry, preferably between about 0.05 and 0.4 weight percent. Normally, the pulp slurry will have a consistency between about 1 and 12 weight percent prior to treatment with sodium sulfate. The sodium sulfate can be added to the pulp slurry as a solid, or more usually it is added as an aqueous solution to facilitate quick and complete mixing. An important feature of the present invention is that the sodium sulfate must be added to the pulp slurry prior to web formation.

FIG. 1 schematically illustrates an embodiment of the process of the present invention. A high consistency bleached, sulfite pulp, having a solids content of about 12 weight percent, is removed from storage vessel 10 and diluted with water to a consistency of less than about 1.0 weight percent. After passing through screens 20 and through centrifugal cleaners 30, the pulp consistency is increased in deckers 40 and then stored in stock chests 50 generally at a consistency between about 2 and 4% by weight.

From the stock chests, the pulp slurry, adjusted to a consistency generally between about 0.2 and 2% by weight, is pumped to a headbox of a typical Fourdrinier pulp (paper) machine 60. A Fourdrinier machine basically consists of a long continuous synthetic fiber or wire screen (the "wire") which is supported by various means to facilitate drainage of water (dewatering) from the pulp slurry. The pulp (fiber) slurry, which is introduced at one end of the machine through the headbox and slice, loses water as it progresses down the wire, thereby forming the web of pulp fibers upon the screen. During web formation on the Fourdrinier, showers or sprays of water are directed onto the forming mat to assist mat formation. Generally, the forming web is showered with a volume of water several times the volume of water originally present in the pulp slurry deposited onto the wire from the headbox. As a consequence of such showers, residual chemicals in the forming mat, including the sodium sulfate added in accordance with the present invention, tend to be washed from the pulp mat. The web then is directed to the press and dryer sections of the pulp manufacturing process.

The pulp dryer section of the pulp manufacturing process usually includes a series of steam-heated cylinders. For example, a suitable machine may have four dryer drive sections with 23 dryer cylinders in the first drive section, 18 dryer cylinders in the second drive section, 20 dryer cylinders in the third drive section and 23 dryer cylinders in the fourth drive section. Alternate sides of the wet pulp web are exposed to the hot surface as the sheet passes from cylinder to cylinder. In most cases, except for heavy board, the sheet is held closely against the surface of the dryers by a fabric having carefully controlled permeability to steam and air. Heat is transferred from the hot cylinder to the wet sheet, and water evaporates. The water vapor is removed by way of elaborate air systems. Most dryer sections are covered with hoods for collection and handling of the air, and heat recovery is practiced in cold climates.

The final consistency of the dry pulp sheet is usually between about 90 and 97% by weight, more typically between about 92–96 weight percent, depending upon the type of pulp product being manufactured. Other mat forming equipment such as the cylinder and twin-wire machines can alternatively be employed, and the present invention is not limited to any particular mat formation procedure or apparatus.

In accordance with the present invention, applicants have found that the energy demands of the pulp drying operation can be reduced by contacting the pulp slurry with sodium sulfate before mat (web) formation. The sodium sulfate should be added to the cellulosic pulp slurry prior to mat formation in a way which facilitates uniform mixing, which is desired for maximum effectiveness. The pulp slurry should be contacted with the sodium sulfate for at least about 30 seconds, preferably at least about 10 minutes, and most preferably at least about 30 minutes before mat formation. Conveniently, the sodium sulfate can be added as an aqueous solution to the stock chests 50 prior to mat formation. Such an arrangement insures a contact time between the pulp and the sodium sulfate of about 30 minutes.

As noted above, at the time of mat formation by dewatering essentially all of the sodium sulfate which has been added is washed from the pulp. Consequently, the dewatered pulp which is passed through the pulp dryers is essentially sodium sulfate free.

The examples which follow are meant to illustrate further the present invention:

EXAMPLE 1

Figure 2:
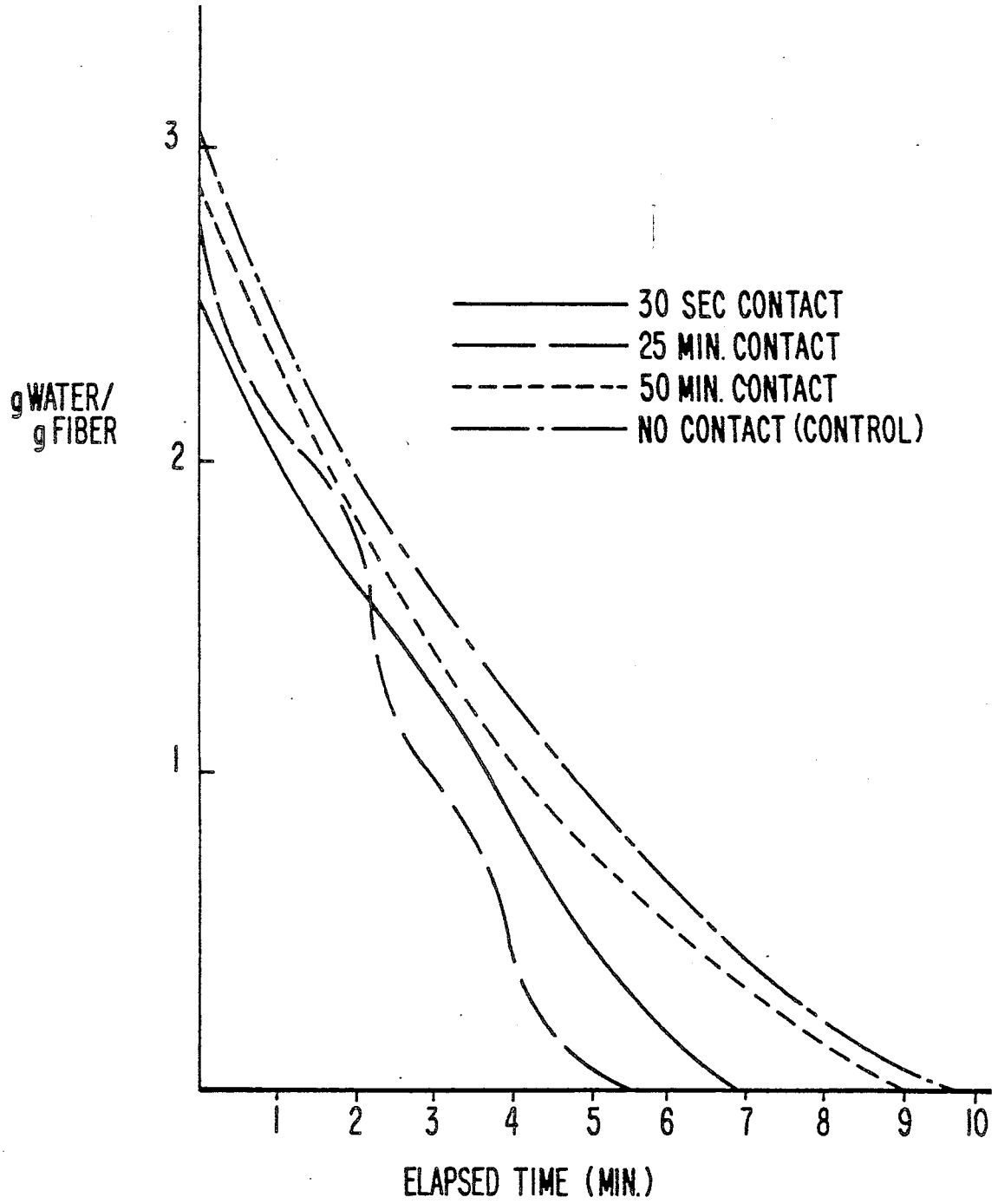
FIG. 2 presents the effect of the duration of sodium sulfate contact time on the rate of drying of a cellulose pulp slurry.

In this example, an attempt was made to simulate the process of web formation and drying of a pulp manufacturing process to examine the effect of contact time between the pulp slurry and sodium sulfate on pulp drying. Four samples of a pulp slurry were prepared each containing about 5.8 grams of pulp fibers. Three of the samples were contacted with 0.012 gram of sodium sulfate (0.2 parts sodium sulfate per 100 parts by weight of pulp solids) and one was retained untreated as a control. Of the three treated samples, one was contacted with the added sodium sulfate for 30 seconds prior to formation of a hand sheet, one was contacted for 25 minutes and one was contacted for 50 minutes. Hand sheets of all four samples then were dried at 300° F. and the fiber moisture content versus time was monitored. The drying results are presented in FIG. 2. As shown, the addition of sodium sulfate enhances the rate of drying.

EXAMPLE 2

A sulfite pulp slurry was treated with about four pounds of sodium sulfate per ton of dry pulp, added as about a 20 wt. % solution. To prepare the sodium sulfate solution, anhydrous sodium sulfate (600 lbs) was added to 400 gallons of water at 45° C. The sodium sulfate solution was added at the pump feeding the pulp slurry to the headbox of the pulp machine. The treatment was continued over a six-hour period. During the trial, steam consumption and pulp production data were collected every half hour. Data showed a 10% by weight reduction in dryer steam consumption relative to dryer operation without the sodium sulfate additive over the 24-hour period following the trial. Pulp quality was also observed during the trial and after and was unaffected by sodium sulfate addition.

The data showed that the added sodium sulfate was not acting as a drainage aid since the pulp moisture content going into the dryer was not appreciably affected by the sulfate addition. A drainage aid would have improved water removal during original web formation and mechanical pressing such that the moisture content of the pulp just prior to the dryer would be reduced.

EXAMPLE 3

A four-day mill trial was conducted wherein about four pounds of sodium sulfate per ton of dry pulp was added to a sulfite pulp slurry prior to the headbox of the pulp machine. During the trial, steam consumption and pulp quality were monitored. Relative to dryer operation just prior to, and just after the trial, dryer steam consumption was reduced by about 5.7% (in the range of about 4 to 6%) by the addition of the sodium sulfate. Since the quantity of water actually removed by the dryer during the trial was substantially the same as that during the control period, the reduction was not due to improved drainage. Evidence suggests that the presence of small amounts of sodium sulfate prior to web formation improves the heat transfer coefficient between the pulp mat and the dryers.

As with the trial of Example 2, no adverse effects on pulp quality were observed due to the use of sodium sulfate.

Although the invention has been described in its preferred forms with a certain degree of particularity, it is understood that various modifications will occur to those skilled in the art and that such modifications are included within the purview of this application and the spirit and scope of the appended claims.

We claim:

1. A method for reducing the energy needed to form a dried market pulp from a cellulosic pulp slurry which comprises contacting said pulp slurry with between about 0.005 and 0.5 parts by weight of sodium sulfate per 100 parts by weight of oven dry pulp solids in said pulp slurry, dewatering said slurry in the presence of a water spray subsequent to said contacting to form a mat of said pulp solids from said pulp slurry, said pulp solids being essentially free of said sodium sulfate and drying said mat, wherein said contacting of said cellulosic pulp slurry with said sodium sulfate is continued for a time sufficient to reduce the energy needed to dry said mat of pulp solids, as compared to a pulp not treated with said sodium sulfate.

2. In a method for forming a dried market pulp product wherein a cellulosic pulp slurry is dewatered in the presence of a water spray to form a pulp mat, said pulp mat is compressed and then heat dried to form said dried market pulp product having a moisture content below about 15 wt. %, the improvement comprising contacting said pulp slurry with between about 0.005 and 0.5 parts by weight of sodium sulfate per 100 parts by weight of oven dry pulp solids in said pulp slurry prior to said dewatering for a time sufficient to reduce the energy needed to heat dry said pulp mat as compared to a pulp not treated with said sodium sulfate, said dewatering forming a pulp mat essentially free of said sodium sulfate.

3. A method according to claim 1 wherein the pulp is dried by passing it in contact with steam heated rollers.

4. A method according to claim 2 wherein the pulp is dried by passing said pulp mat in direct contact with a steam heated roller.

5. A method according to claim 1 wherein said sodium sulfate is added in an amount between 0.05 and 0.4 parts by weight per 100 parts by weight of oven dried pulp solids in said slurry.

6. A method according to claim 2 wherein said sodium sulfate is added in an amount between 0.05 and 0.4 parts by weight per 100 parts by weight of oven dried pulp solids in said slurry.

7. A method according to claim 1 wherein said pulp slurry is a sulfite pulp.

8. A method according to claim 2 wherein said pulp slurry is a sulfite pulp.

9. A method according to claim 1 wherein said pulp slurry is a Kraft pulp.

10. A method according to claim 2 wherein said pulp slurry is a Kraft pulp.

11. A method according to claim 4 wherein the pulp is dewatered through a screen.

12. A method according to claim 1 wherein said contacting time is at least 10 minutes.

13. A method according to claim 2 wherein said contacting time is at least 10 minutes..

14. A method according to claim 12 wherein said sodium sulfate is added into a thick stock chest of a pulp manufacturing system.

15. A method according to claim 13 wherein said sodium sulfate is added into a thick stock chest of a pulp manufacturing system.

* * * * *